United States Patent [19]

Tarancon

[11] Patent Number: 4,950,370

[45] Date of Patent: Aug. 21, 1990

[54] ELECTROLYTIC GAS GENERATOR

[75] Inventor: Gregorio Tarancon, Woodbridge, N.J.

[73] Assignees: Liquid Air Corporation, Walnut Creek, Calif.; Tarancon Research & Engineering Services Inc., Lake City, Ga.

[21] Appl. No.: 221,366

[22] Filed: Jul. 19, 1988

[51] Int. Cl.[5] ..... C25B 1/24; C25B 9/00

[52] U.S. Cl. ..... 204/128; 204/129; 204/255; 204/256; 204/257; 204/258

[58] Field of Search ..... 204/128, 129, 255, 257, 204/258, 262, 254, 256, 266

[56] References Cited

U.S. PATENT DOCUMENTS 2,793,182 5/1957 Visnapuu ..... 204/257
4,439,297 3/1984 Kircher et al. ..... 204/263

FOREIGN PATENT DOCUMENTS 346774 4/1931 United Kingdom ..... 204/128

*Primary Examiner*—John F. Niebling
*Assistant Examiner*—Kathryn Gorgos
*Attorney, Agent, or Firm*—Oblon, Spivak, McClelland, Maier & Neustadt

[57] ABSTRACT

An apparatus and a method is disclosed for generating fluorine which has an improved efficiency by reducing the resistance between the electrodes and by reducing the chemical action on the electrodes through a design whereby the structure and positioning of the electrodes as well as the flow of electrolyte provide this reduction of the resistance. The shape of the cell unit constituting the electrode structure reduces the chemical action on the electrode by increasing the flow of electrolyte past the electrode structure.

31 Claims, 15 Drawing Sheets

ELECTROLYTIC GAS GENERATOR

BACKGROUND OF THE INVENTION

1. Field of the Invention

The present invention is addressed to an electrolytic apparatus for generating fluorine and more particularly to an improved efficient device providing for reduced resistance between the electrode and reduced chemical action on the electrode.

2. Discussion of Background

Of the many types of electrolytic apparatuses which are known and commercially used from manufacturing fluorine, they all are subject to problems with respect to either reduced efficiency due to a resistance which builds up between the cathode and the anode or a shortened electrode life due to the chemical action on the electrode or unsafe operation of the structure because of gas diffusion. Many types of apparatus suffer from more than one of these problems.

The state of the art in the area of electrolytic production of fluorine provides ample proof that the increase in the resistance between the cathode and the anode provides a negative effect on the efficiency of the electrolyzer because of the increased power consumption and heat generation. Although different cells have been utilized for fluorine gas manufacture, each of these cells utilize a stationary electrode which has low current efficiencies and which suffers from a decreased life of the anode and even occassionally suffers explosions within the cells. Additionally, high overvoltages are reported in such cells which almost double the potential which must be applied to the cell in order to cause a given current to flow. These types of cells which are used for fluorine gas manufacture are discussed in "Preparation of Fluorine" by Cady, Rogers, and Carlson, University of Washington, Seattle, Wash.

A discussion of the high electrical resistance which develops over time and which leads to low efficiency and overheating in the cells used in the prior art as well as the use of non-metallic components with a construction of the cell is disclosed by Tricoli et al in U.S. Pat. No. 3,773,044. U.S. Pat. No. 3,320,140 by Yedis entitled "Electrolytic Production of Fluorine" discusses the use of non-metallic construction materials, such as polyethylene, polytetrafluoroethylene, or other plastics in the production of fluorine. A discussion of commercial grade fluorine is contained in the "Kirk-Othmer Encyclopedia of Chemical Technology".

SUMMARY OF THE INVENTION

Accordingly, one object of the present invention is to provide an improved electrolytic apparatus for manufacturing fluorine which provides improved efficiency by reducing the resistance between the anode and the cathode.

It is a further object of the present invention to provide an electrolytic apparatus for generating fluorine which has an improved life span of the electrodes by reducing the chemical action on the electrodes.

It is a further object of the present invention to provide a fluorine producing apparatus which has improved safety due to reduction of gas diffusion between the anode and the cathode by maintaining parallel flow direction of the electrolyte in the electrolyzer.

It is a further object of the present invention to provide a system wherein the temperature can be controlled through the utilization of an external heat exchanger providing on demand heating and cooling.

It is a further object of the present invention to provide an electrolyzer which produces high purity fluorine by using electrodes that do not generate byproducts, and by removal of HF at a low temperature which is subsequently recovered and sent to the electrolyzer.

It is a further object of the present invention to provide an electrolyzer which prevents crystal formation inside the electrolyzer by maintaining parallel flow direction of the electrolyte in the electrolyzer.

It is a further object of the present invention to provide an electrolyzer which prevents freezing at room temperature environment.

It is a further object of the present invention to provide an electrolyzer that can easily add to or reduce the number of cell units.

It is a further object of the present invention to provide an electrolyzer in which the flow dynamic of the electrolyte in the anolyte and catholyte zones of the electrolyzer is a parallel flow inlet end plate opposite to the end plate.

It is a further object of the present invention to provide an electrolyzer wherein the resistance between anode and cathode remains the same for all the cell units in the electrolyzer.

It is a further object of the present invention to provide an electrolyzer wherein the pressure differential across the electrolyte zone for all the cell units remains the same.

It is also a further object of the present invention to provide an improved electrode geometry and a newly configured cell unit module which promotes the optimum velocity across the cell units parallel to each electrode in order to avoid gas accumulation inside the electrolyzer.

It is a further object of the present invention to provide a compact monopolar electrolyzer wherein both sides of each electrode can be used in order to increase the efficiency of the electrolyzer.

It is a further object to provide a structure whereby the gas concentration in the electrolyte is decreased over the prior art in order to prevent diffusion from one electrode zone to another electrode zone.

The present invention also has for an object the utilization of a system wherein each electrode is able to generate one gas on both sides of the electrode to improve the compatibility of the anode with fluorine and of the cathode with hydrogen in monopolar electrolyzers.

It is a further object of the present invention to reduce leakage through electrode connection points in monopolar electrolyzers by using only two external electrical connections for the electrolyzer.

It is a further object of the present invention to provide improved monopolar and bipolar electrolyzers which are formed of compact filter press structure in which each module is framed with a plastic material and wherein the housing for the bracing and support of the modules which forms the frame for the electrolyzer is made of a metal.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 4A details the frames of the monopolar electrolyzer structure of each of the cell units of FIG. 3A;

DESCRIPTION OF THE EMBODIMENTS

Figure 1A:
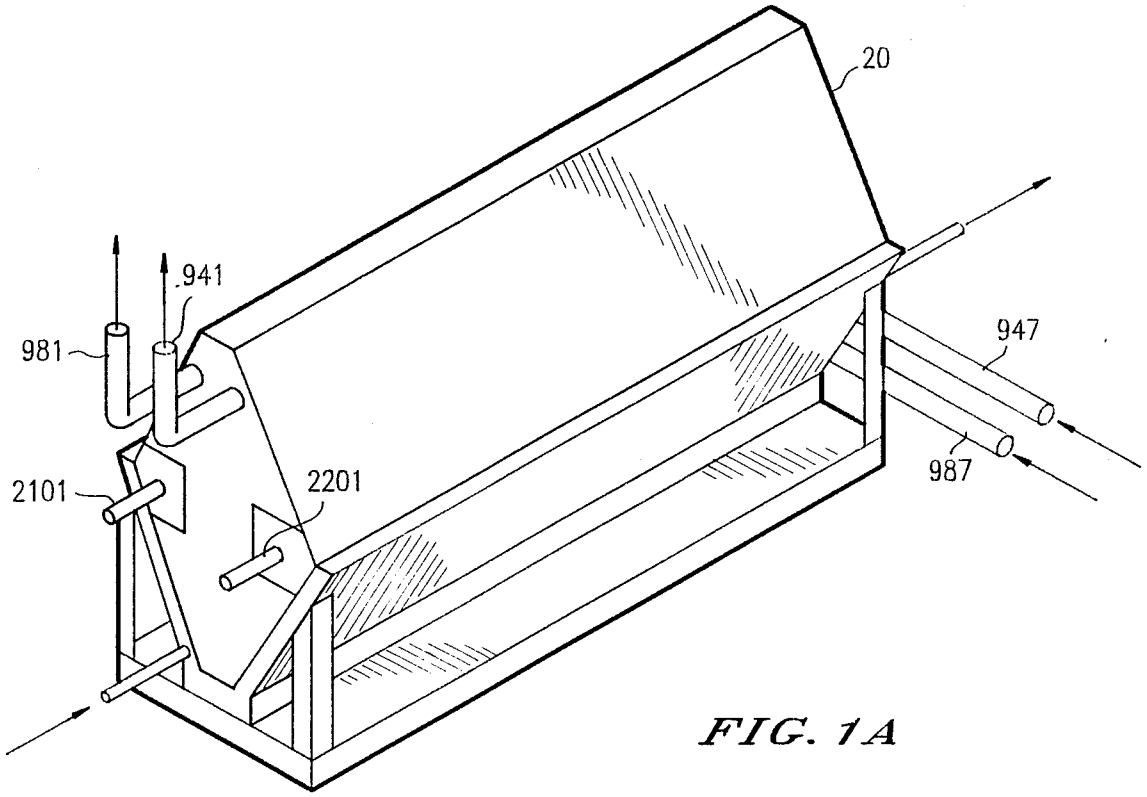
FIG. 1A contains an electrolyzer with monopolar electrodes according to the present invention and FIG. 1B depicts the electrolyzer with bipolar electrodes according to the present invention.
Figure 1B:
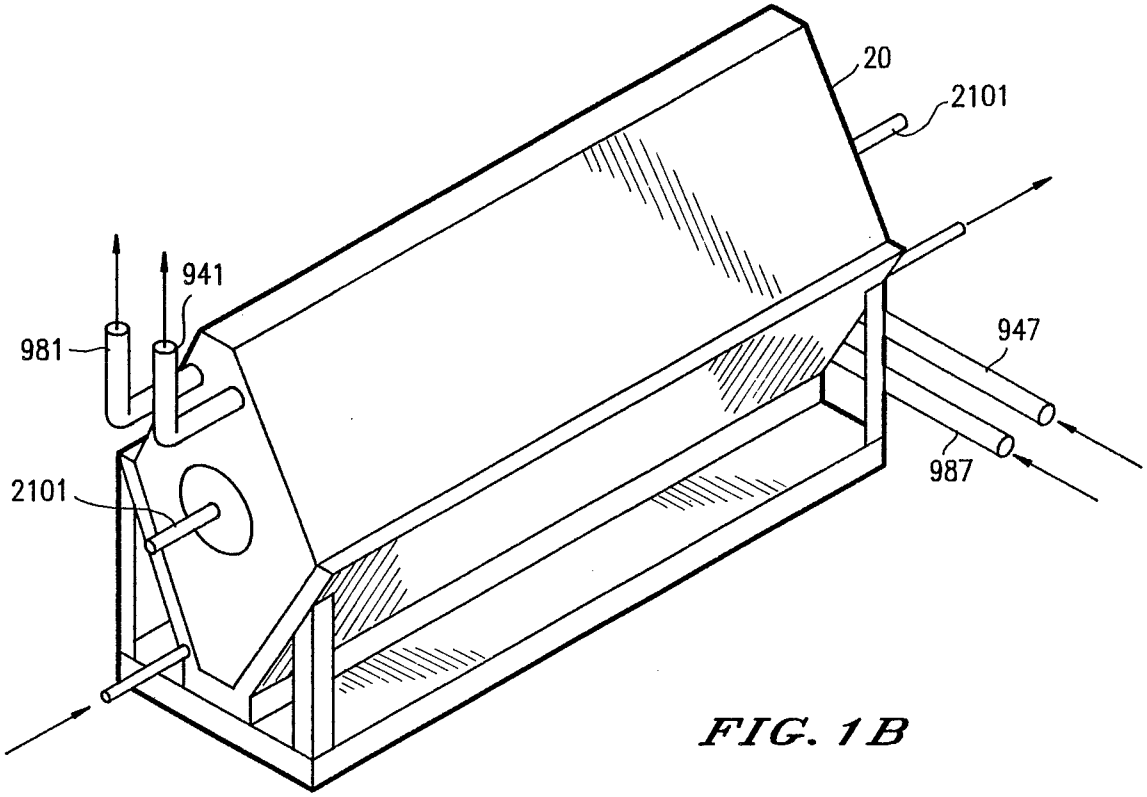

Referring now to the drawings, wherein like reference numerals designate identical or corresponding parts throughout the several views, and more particularly to FIG. 1 thereof there is shown the electrolytic apparatus according to the present invention with FIG. 1A using an electrolyzer with monopolar electrodes and FIG. 1B using an electrolyzer with bipolar electrodes. The electrolyzers of FIGS. 1A and 1B are fluorine gas generators, made up of a plurality of anode-cathode electrode cells contained in a housing, 20, which is made of an insulating material or of a suitably insulated metal.

Figure 2:
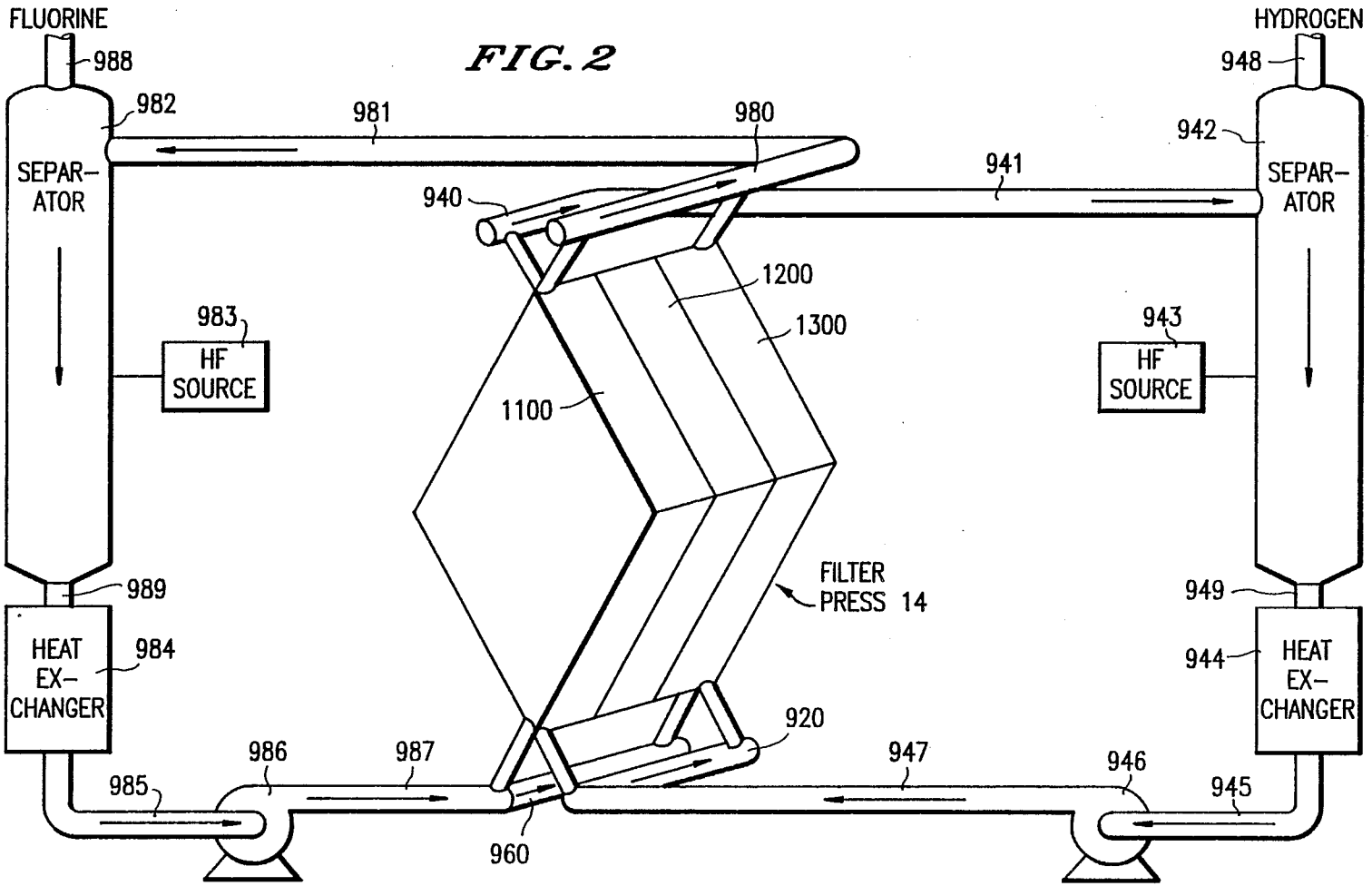
FIG. 2 depicts the process apparatus for the electrolysis of hydrogen fluoride into fluorine gas and hydrogen according to the present invention.

The FIG. 2 details the apparatus of FIG. 1 with respect to the electrolysis portion contained inside of the housing 20 and of the separator elements which are not shown in FIG. 1. The filter press 14 is made of a plurality of electrodes contained in the housing 20 from FIG. 1. The bottom portion of the filter press 14 has electrolyte manifold distributors 920 and 960. The top portion of the filter press 14 has the collector manifolds for the two phase flow (electrolyte and gas), manifolds 940 and 980. This upper manifold 980 connects the filter press 14 with the separator 982 through the pipe 981. The two phase flow is discharged in the separator 982 to separate the gas fluorine which goes up through the top pipe 988. The electrolyte then passes down to the heat exchanger 984 through pipe 989. The temperature of the electrolyte is adjusted to be the operating temperature in the heat exchanger 984. This electrolyte is circulated back to the electrolyzer through the heat exchanger 984 by means of pipe 985 into the pump 986. The pump discharges the electrolyte into the manifold 960 through the pipe 987 with the upper manifold 940 connecting the filter press 14 with the separator 942 through pipe 941. The two phase flow is discharged into the separator 942 thereby separating the hydrogen gas which goes through the top pipe 948. The electrolyte then goes down to the heat exchanger 944 through the pipe 949. The temperature of the electrolysis is adjusted to the operating temperature in the heat exchanger 944, and the electrolyte is circulated back to the electrolyzer from the heat exchanger 944 through the pipe 945 into the pump 946. Subsequently, the electrolyzer is discharged into manifold 920 through the pipe 947. The sources 983 and 943 provide HF to the separator.

The filter press 14 is made up of several single anode-cathode cell units with three of these units 1100, 1200 and 1300 being shown in FIG. 2.

Figure 3A:
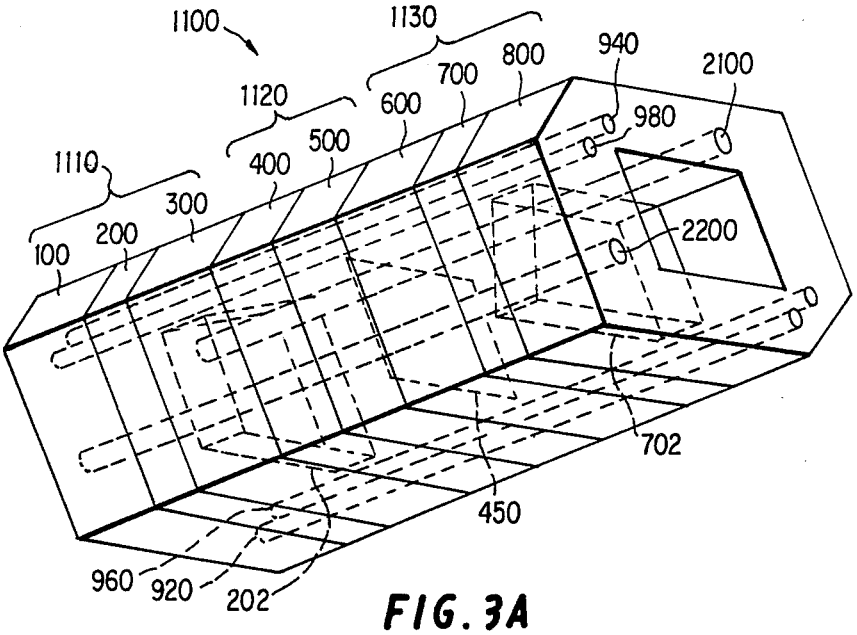
FIG. 3A details a single anode-cathode cell unit of a monopolar electrolyzer cell unit of FIG. 2.
Figure 3B:
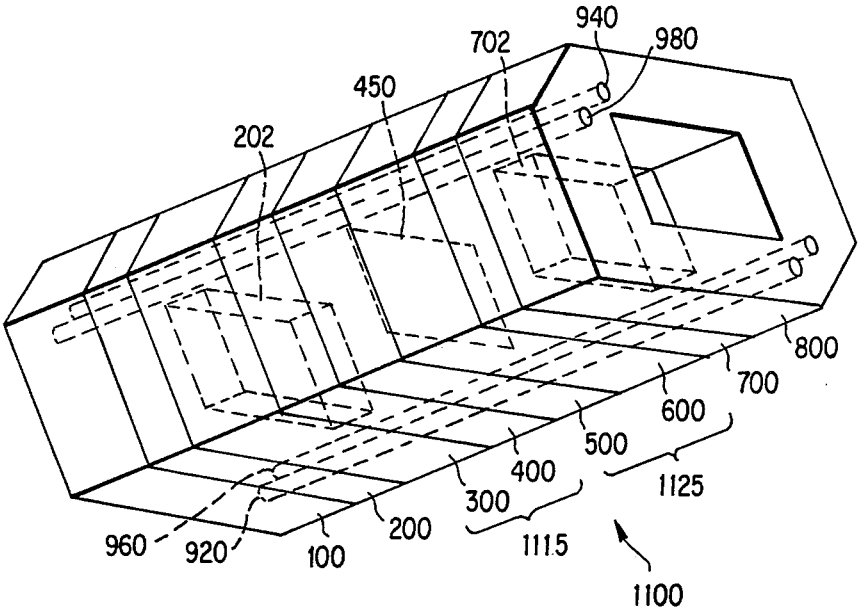
FIG. 3B details a bipolar electrolyzer cell unit structure for a single anode-cathode cell unit.
Figure 44:
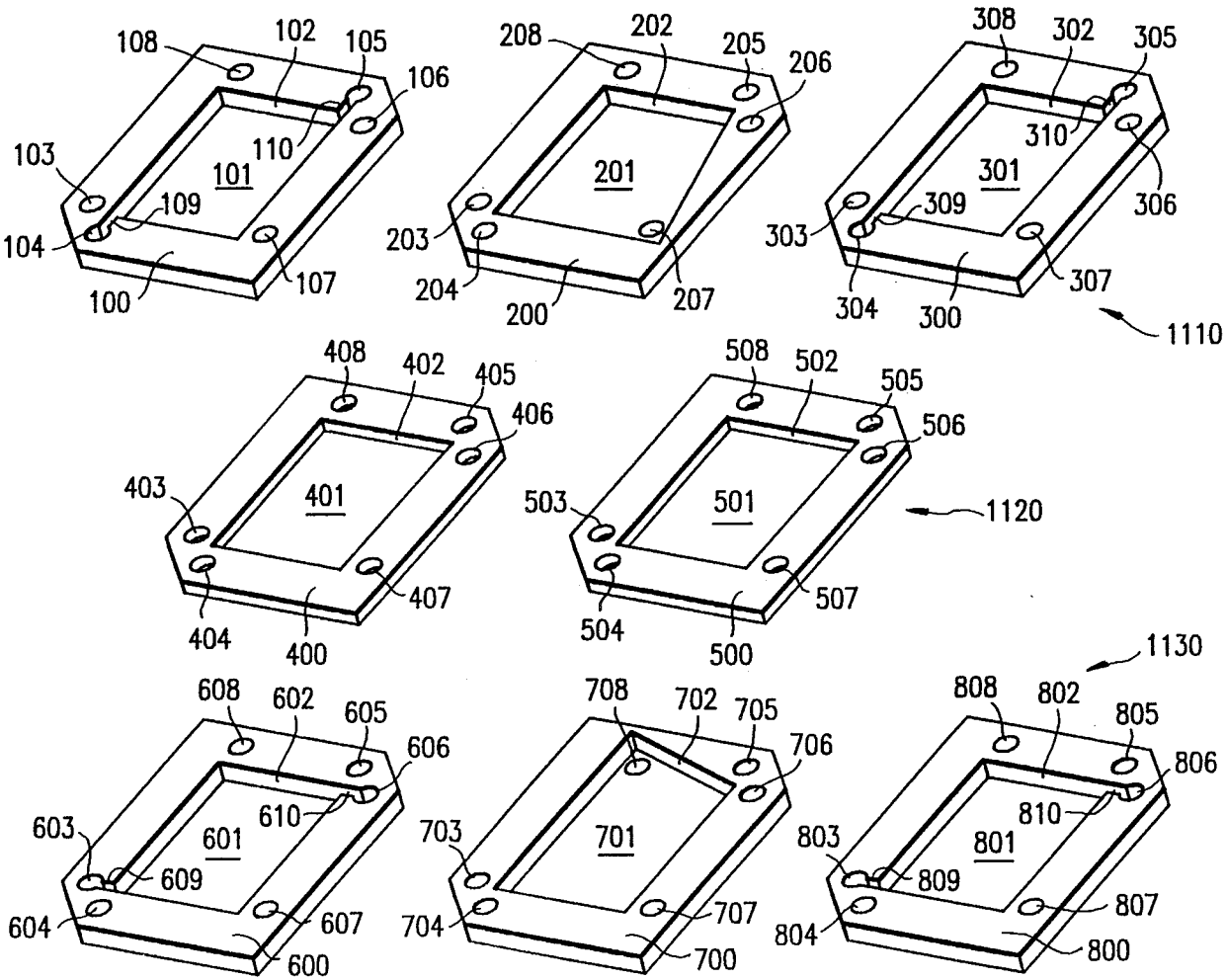
Figure 4B:
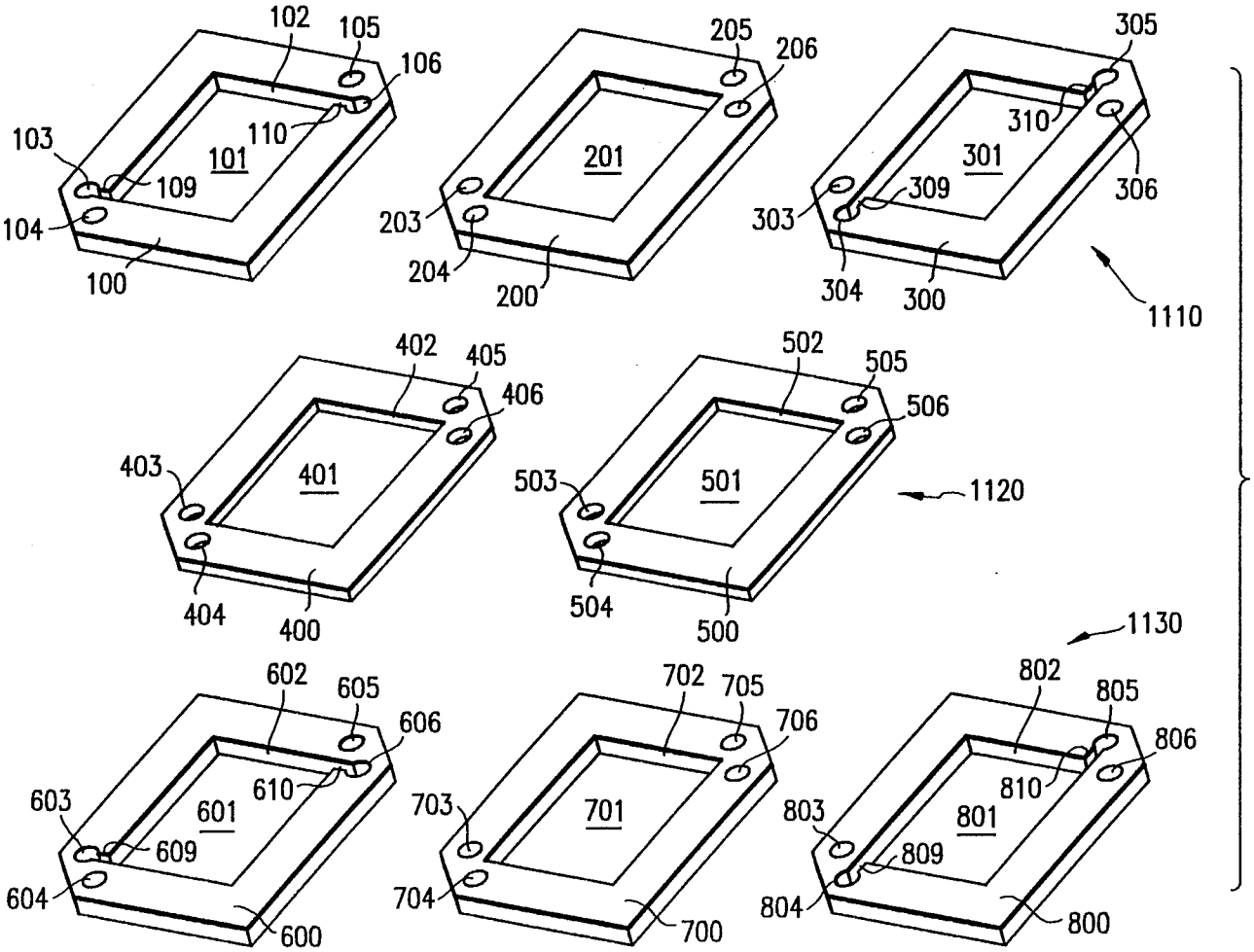
FIG. 4B details the electrode assembly and frame structure of each of the bipolar electrolyzer frames of FIG. 3B.

Each single anode-cathode cell unit is constructed as shown in FIG. 3 with the structure of FIG. 3A detailing a monopolar electrolyzer cell unit and the FIG. 3B showing a bipolar electrolyzer cell unit. The FIG. 3A shows one of the units 1100 of the filter press 14 of FIG. 2. Each anode-cathode cell unit includes a cathode assembly 1110 and an anode assembly 1130 which are separated from each other by the membrane assembly 1120. The cathode assembly 1110 is further detailed in FIG. 4A which includes insulating plates or frames 100, 200 and 300. The frame 100 is the left-side cathode frame which has a central opening 101 in which a planar cathode electrode 202 is exposed to the active surface on the left side. The opening 101, having the thickness of the frame 102, is a portion of the left side electrolyte cavity. The frame 200 is the electrode cathode frame and the planar cathode electrode 202 is seated in an electrode space 201 formed around the opening in the frame 200. The frame 300 is the right-side cathode frame having a central opening 301 in which a planar cathode electrode 202 is exposed to the active surface on the right side. The opening 301, having the thickness of the frame 302, forms a portion of the right-side electrolyte cavity. The frames 100, 200 and 300 are sandwiched together with a central opening formed by 101 and 301. The planar electrode cathode 202 is inserted in the electrode cathode frame 200 and it occupies the space indicated at 201.

The anode assembly 1130, as well as the cathode assembly 1110 includes three frames which are, for the anode assembly 1130, labelled 600, 700 and 800. The frame 600 is the left-side anode frame which has a central opening 601 in which a planar anode electrode 702 is exposed to the active surface on the left-side. The opening 601 having the thickness of the frame 602 is a portion of the left-side electrode cavity with frame 700 being the electrode anode frame with the planar anode electrode 702 seated in the electrode space 701 formed thereon the opening in the frame. The frame 800 is the right-side anode frame which has a central opening 801 in which a planar anode electrode 702 is exposed to the active surface on the right side. The opening 801 having the frame thickness 802 forms a portion of the right side electrolyte cavity. The frame 600, 700 and 800 have a central opening 601 and 801 with a planar electrode anode 702 being inserted into the electrode anode frame 700 where it occupies the space indicated at 701.

Located between the anode assembly 1130 and the cathode assembly 1110 is the membrane assembly 1120 which also includes frames this time labeled frames 400 and 500. The membrane assembly also includes the diffuser membrane 450. The left-side membrane formed by frame 400 has a central opening 401 and a thickness of 402. The right-side membrane frame 500 has a central opening 501 and a thickness of 502. The frames 400, membrane 450 and frame 500, form a sandwich with the membrane 450 secured in place.

Specifically referring to FIG. 3A the monopolar anode and cathode cell 1100, in which cathode assembly 1110, membrane assembly 1120 and anode assembly 1130 are united, form the cell unit. Referring to FIG. 4A, the cathode assembly 1110, shown in the left-side cathode frame 100 additionally has the bottom manifold 104 and the slot orifice for electrolyte introduction into the left-side catholyte zone. The top manifold 105 has a slot orifice for the two phase flow which passes from the catholyte zone to the manifold 105. The opening corresponding to 103 is a part of the bottom anolyte manifold with the opening corresponding to 106 being a part of the top anolyte manifold. The opening corresponding to 107 is a part of the cathodic busbar with the opening corresponding to one 108 being a part of the anodic busbar.

More specifically referring to FIG. 3A, the cell unit 1100 extends from frame 100 to frame 800 with the openings corresponding to the bottom anolyte manifold being 103, 203, 303, 403, 503, 603, 703 and 803. The openings which correspond to the bottom catholyte manifold are reflected by the numbers 104, 204, 304, 404, 504, 604, 704, 804 from the FIG. 4. The openings which correspond to the top anolyte manifold are reflected by 106, 206, 306, 406, 506, 606, 706 and 806. The openings which correspond to the top catholyte manifold are 105, 205, 305, 405, 505, 605, 705 and 805. Meanwhile, the openings which correspond to the cathodic busbar are 107, 207, 307, 407, 507, 607, 707 and 807. Lastly, the openings which correspond to the anodic busbar are 108, 208, 308, 408, 508, 608 and 808.

In a similar manner, the assembly 1110 communicates with the electrolyzer catholyte zone with the bottom catholyte manifold and with the top catholyte manifold through the slots 109, 110, 309 and 310. The other assemblies such as 1130 provide communication between the anolyte zone, the bottom anolyte manifold and the top anolyte manifold through the slots 609, 610, 809 and 810.

A single bipolar electrolyzer cell unit 1100 is shown in FIG. 3B. A press unit 14 of FIG. 2 contains a plurality of these cell units. Each cell includes a anode-cathode electrode assembly 1110 and 1130 separated by a membrane assembly 1120. The anode-cathode assembly 1110 shown in FIG. 4B includes first insulating plates or frames 100, 200, 300. The frame 100, is the anode side, and has a central opening 101 in which a planar electrode 202 is exposed to the active surface on the left side. The opening 101, having a frame thickness 102, is a portion of the left side electrolyte cavity. The frame 200 is the electrode cathode frame, and the planar cathode electrode 202 is seated in the electrode space 201 formed around the opening in the frame 200. The frame 300 is the right-side frame which has a central opening 301 in which a planar electrode 202 is exposed to the active surface of the right side. The opening 301, having the frame thickness 302, is a portion of the right side electrolyte cavity. The frames 100, 200, 300 are sandwiched together having central openings 101, 301 with the electrode frame 200 having the planar electrode 202 seated in the electrode space 201. The three frames 100, 200 and 300 form a sandwich where the electrode is securely placed. The assembly 1130, similar to the assembly 1110, includes the frames 600, 700 and 800. The frame 600 is the left-side anode frame having a central opening 601 in which a planar electrode is exposed on the active surface of the left side. The opening 601, having a frame thickness 602, is a portion of the left side electrolyte cavity and the frame 700, which is the electrode frame, has the planar electrode 702 seated in the electrode space 701 which is formed around the opening in the frame 700. The frame 800 is the right-side frame which has a central opening 801 in which a planar electrode is exposed to the active surface on the right side. The opening 801, with the frame thickness 802, is a portion of the right side electrolyte cavity. The frames 600, 700 and 800 have the central opening 601 and 801, respectively. The electrode frame 700 has the planar electrode 702 seated in the electrode space 701. The three frames 600, 700 and 800 form a sandwich where the electrode is securely placed.

The membrane assembly 1120, in a similar manner, includes frames which are labeled as 400 and 500 as well as a diffuser membrane 450. The left-side membrane frame 400 has a central opening 401 and a thickness 402. The right-side membrane frame 500 has a central opening 501 with a thickness of 502. The frame 400, the membrane 450 and the frame 500 forms a sandwich where the membrane is secured. With specific reference to FIG. 3B, the bipolar electrode cell 1100 consisting of the electrode assembly 1110, the membrane assembly 1120 and the electrode assembly 1130 forms the cell unit. With regard to FIG. 4B, the electrode assembly 1110, which is shown on the left-side of the electrode frame 100, has the bottom manifold 103 with the slot orifice for electrode introduction into the left side of the electrode. The top manifold 106 has a slot orifice for the two phase flow from the electrolysis zone to the manifold 106. When the left side electrode is the anode, of course, the right side is the cathode.

The opening 104 is a part of the catholyte manifold zone with the opening 105 being a part of the top catholyte manifold. The openings 304 and 305 connect the catholyte zone with the bottom and top manifolds. The section 1115 and the assembly frames 300 and 400, correspond to the catholyte zone with the section 1125, having the assembly frames 500 and 600, corresponds to the anolyte zone.

The insulating frames may be may of plastics such as fluorinated polyethylene, or the like and the anode may be made of nickel or the like while the cathode may be of copper and the membrane may be of a perfluorinated polyethylene. According to the preferred embodiment, the apertures in the frames are all of the same size and shape as are the anode and the cathode electrodes with the shape of the electrodes being selected to provide optimum efficiency by eliminating gas accumulation on the electrodes and for optimizing gas flow. The factors which effect the resistance between electrodes in an electrolytic gas generator include the electroconductivity of the electrolyte, the distance between the electrode surfaces, and the electrical resistance of the electrolyte diffuser. The addition of ionic salts to an electrolyte increases its electroconductivity. One of the factors which has been found to be extremely important in the steady operation and performance of the electrolyte cell is the gas concentration in the electrolyte and on the surface of the electrodes. This discovery is such that, as the concentration of the gas increases in the electrolyte and/or on the surface of the electrodes, the resistance and the voltage necessary to produce the electrolysis increases proportionally. This, in turn, induces a larger energy "attack" on the surfaces of the electrodes.

In order to maintain the gas concentration as low as possible in the electrolyte zone of the generator, two parameters must be considered. The first parameter relates to the physical design of the electrolyzer and the other to the operation of the unit. The physical design of the cell unit must have a geometry which eliminates gas accumulation. The design possibilities, such as a square and a rectangle are immediately rejected because they contain pockets in the corners in which the gas which is generated can accumulate. This accumulation in the corners can lead to an attack on the electrode, an increase in the electrical resistance of the electrolyte and the possibility of gas diffusion across the electrolyte diffuser.

Figure 5:
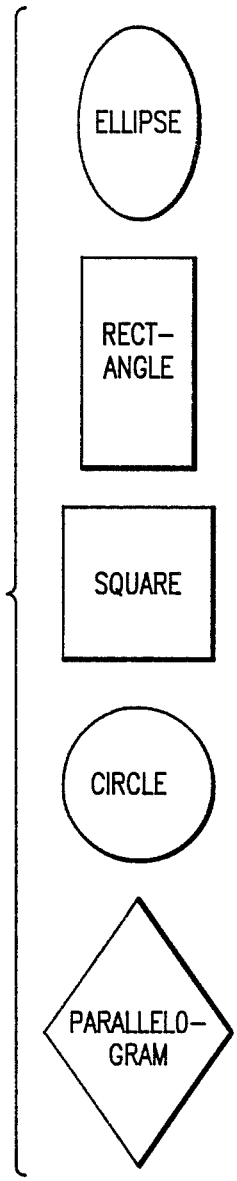
FIG. 5 illustrates a plurality of design possibilities with respect to the shape of the electrodes and the cell frame.
Figure 6B:
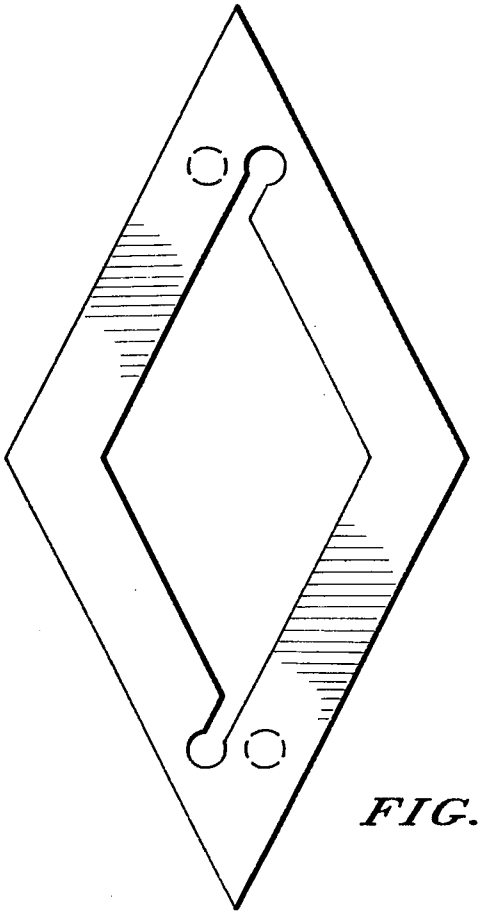
FIGS. 6A and 6B present the configuration for the electrodes and the cell frame which provides the best configuration according to the present invention.
Figure 6A:
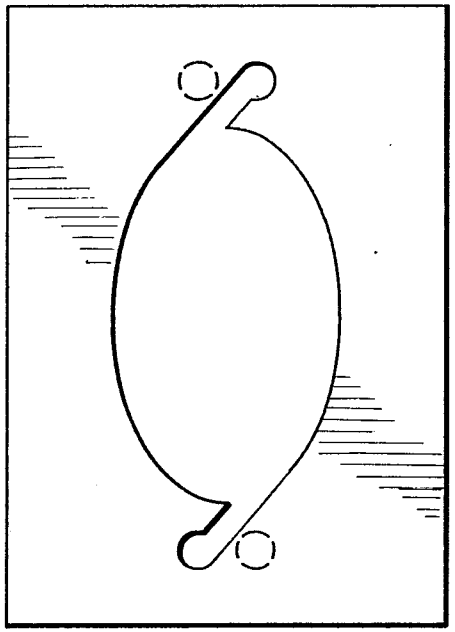

The several possible design configurations of FIG. 5 have been studied with the resultant elliptical design of FIG. 6A for the electrodes and the cell frame presenting the best configuration for the dynamics of the electrolyte as well as for reducing gas accumulation at any point in the parameter of the electrode frame. It is to be noted, however, that in the family of ellipses, with respect to the ratio of the major diameter to the minor diameter, the number of possibilities is infinite. In order to narrow the range of possibilities, it was also observed that, as the ratio of the major diameter to the minor diameter approaches one, the efficiency was noted to decrease with respect to the gas accumulation and the dynamics of the system assuming that gas flow is in the direction of the major diameters.

Utilizing this observation, a lower limit was found by considering the ratio of the major diameter to the minor diameter greater than 1, and the major diameter 15 in the vertical position with the minor diameter being in the horizontal position. On the other hand, if the major diameter is extremely large when compared with the minor diameter, the cross-sectional area of flow decreases proportionally with a decrease in the small diameter. If the volumetric flow rate is constant for the unit area of the electrode, then the velocity increases proportionally to the decrease in the minor diameter. The dynamics of the fluid change and the turbulence characteristics will affect the resistance of the electrolyte. The major distance vertically affects gas traveling from the bottom portion of the electrode to the top portion of the electrode.

In addition to the elliptical geometry of FIG. 6A, similar geometries in FIG. 6B, for example, can be considered as equivalent. For example the rhombus parallelagram inscribed in the ellipse is such that the diagonals correspond to the major and minor diameter and, in general, any geometry which is then inscribed in the ellipse and circumscribed in the rhombus parallelagram, can be considered in the family of geometries for this invention as detailed in FIG. 7.

Figure 7:
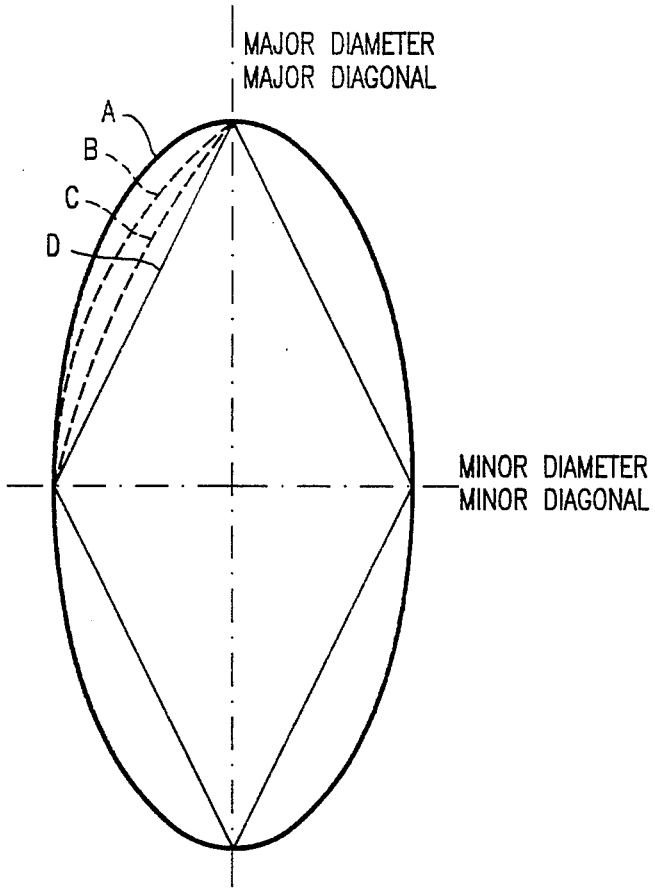
FIG. 7A provides alternate geometries which are similar to that shown in FIG. 6B which can be equivalently used as the design for the electrodes and the cell frame.

The following conditions constitute a preferred geometry inscribed in the ellipse and circumscribed in the rhombus parallelagram of FIG. 7:

(a) two perpendicular distances one vertical (the major), and one horizontal (the minor), called diagonals, or diameters;

(b) the ratio between the two distances, the major (diameter or diagonal) and the minor (diameter or diagonal) is greater than 1 and smaller than 10. The lower limit (i.e. greater than 1), prevents gas accumulation on the perimeter of the electrode and on the frame while the higher limit, i.e. less than 10, prevents a tubular configuration which, in general increase the turbulence. The effect of the circulation with respect to the gas concentration in the electrolyte and the resistance between the electrodes is detailed in FIG. 8;

(c) the surface area of the geometry is equal to the product of the major (diameter or diagonal) times the minor (diameter or diagonal) times a constant value. If the geometry is an ellipse, then the constant is equal to pi/4;

(d) the electrolyte inlet and outlet are tangential to the lowest point in the lower manifold, and are tangential to the upper point in the upper manifold. (A comparison has to be made at a constant volumetric rate with respect to the area of the electrode.)

The Reynolds Number increases as the linear velocity increases, and therefore, the utilization of these limiting factors or preferred conditions does not exclude geometries which only use portions of the designed possibilities. That is, figures where the top portion is elliptical and the bottom portion is circular, or where the top portion is a parallelagram and the bottom is a circle, or any combination without limit is available under the present system and within the preferred limitations or conditions for the geometry.

The turbulence of the fluid is measured by the Reynolds Number, where the equivalent diameter is the square root of the minor diameter, and the linear velocity is a function of the cross-sectional area of flow. Viscosity and density are functions of the electrolyte, pressure and temperature, as is known.

Conventional monopolar electrodes produce gas with the low efficiency, due not only to a high gas concentration in the electrolyte, but also due to the fact that most systems have the surfaces of the electrodes which are at different perpendicular distances from each other.

According to the present invention as shown in FIG. 1, the cathodes 202 are electrically connected to an internal cathode's busbar, 2100, and the anodes 702 are electrically connected to an internal anode busbar 2200. In one arrangement, each anode has a hole 708 near its right hand margin with a metal rod, acting as the busbar 2200, which is inserted through the aligned holes in the anodes. A tab or lead 2201 extends from the anode busbar 2200, through the housing 20 to the outside in order to establish an electrical connection.

In a similar manner, each cathodes 202 has a hole 207 near its left side with all of the cathode holes being aligned and the cathode busbar 2100 is inserted in the aligned cathode holes 207. An external lead 2101 extends from the cathodes busbar 2100 through the housing 20 to the outside in order to establish electrical connection.

Figure 9A:
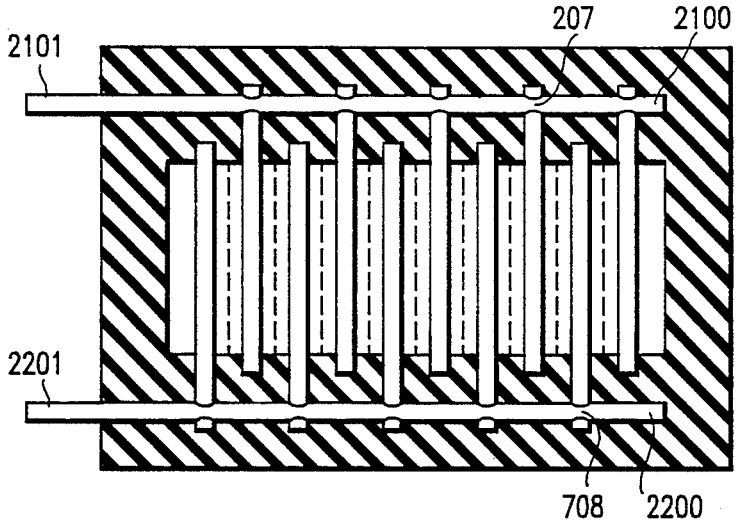
FIGS. 9A and 9B respectively provide the electrical interconnection structure of the electrolyzers for a monopolar electrolyzer and a bipolar electrolyzer.
Figure 9B:
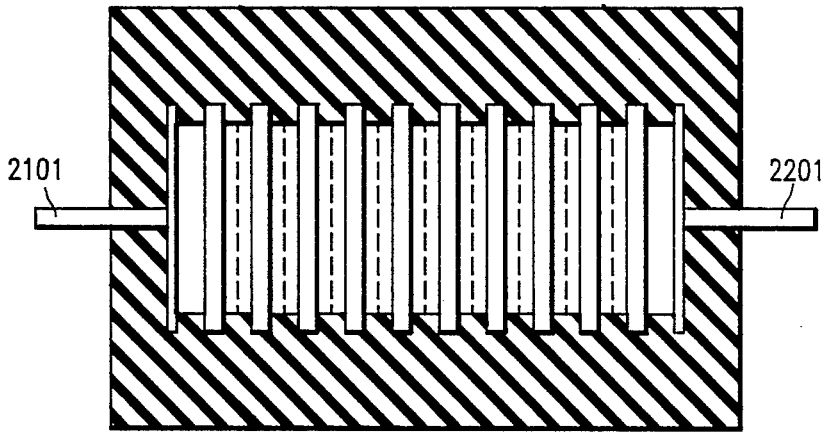

Another electrode-to-busbar connection scheme is shown in FIG. 9A where the anodes and the cathodes have notches in their peripheries or edges which receive respective busbars. The FIG. 9A illustrates a monopolar electrolyzer, which is a compact unit with internal busbars while FIG. 9B illustrates a bipolar electrolyzer, according to this scheme, with external busbars, connected to the end plates.

The construction of the anode and cathode cells themselves will now be explained with reference to FIGS. 1–4. Each cathode cell has a lower inlet pipe 947 to which it is connected, and the pipe 947 is extended through the housing 20. The pipes 947 are all connected to a single manifold 920 with the cathodes outlets 110 and 310 being connected to an outlet manifold 940. In a similar manner, the anode inlet pipes 987 are all connected to an inlet manifold 960 while the anode outlet pipes 981 are all connected to an outlet manifold 980.

Figure 10B:
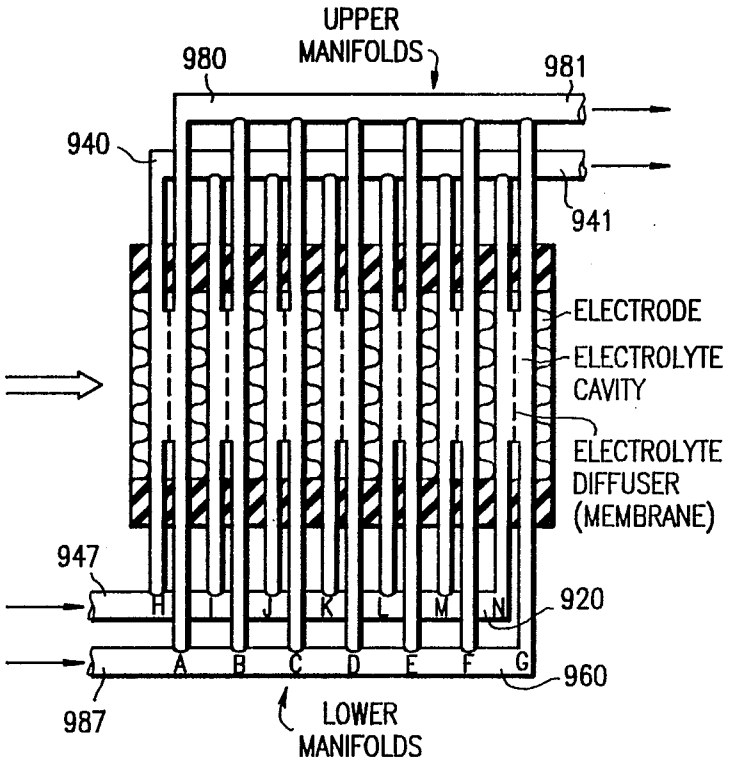
FIGS. 10A and 10B illustrate electrolyte flow of countercurrent and parallel bipolar electrolyzers respectively.

The FIGS. 6A and 6B illustrate an optimum arrangement for the inlet and outlet pipes wherein the outlet pipes are tangent to the highest point in the upper manifold and the inlet pipes are tangent to the lowest point in the lower manifold. The various anode and cathode cells with their inlet and outlet pipes and their manifolds are schematically shown in FIGS. 10B and 11B.

FIG. 2 provides that the system includes an electrolyzer filter press 14, 2 electrolyte circulation pumps 946 and 986, heat exchangers 984 and 944, separators 982 and 942, and sources of hydrogen fluoride 983 and 943 which are coupled by pipes. A source of hydrogen fluoride is coupled to each separator for the addition of hydrogen fluoride to each separator during the system operation.

The direction of flow is the same for the feed pipes 947 and 980. Similarly, the direction of flow is the same for both pipes 987 and 940. This construction of the direction of flow provides optimum pressure in the manifold and the feed pipes as is illustrated in FIGS. 10B and 11B.

The electrolyte for the electrolysis of hydrogen fluoride into gases, fluorine and hydrogen, must be a liquid which is free of crystal at the temperature that the process will be established. The liquid electrolyte has to be an ionic solution with high electrical conductivity in which the ion travels to the electrode. At the side of the electrodes, the electrochemical reaction occurs which forms the fluorine and hydrogen gases. This liquid electrolyte must have a wettability property in order that the surface of the electrode remains wet upon the release of a small diameter gas bubble of fluorine or hydrogen as these particular gases are generated at the surface of the electrode. That is, this is necessary to decrease the polarization of the electrode.

A good electrolyte may be summarized as having the following properties:

(1) it must contain a component source of product-hydrogen fluoride, which generates fluorine and hydrogen;

(2) it must contain a component source of ions which maintain the electrolyte as an ionized solution;

(3) it must contain a component which controls the electrodes polarization; and (4) it must contain a component which maintains the eutectic of the solution below the operating temperature.

A simple and exemplary manner of obtaining the electrolyte solution, containing the above recited four properties, involves combining the components and inducing the properties in the electrolyte. As an example, the electrolyte may contain hydrogen fluoride, which is the source of electrolysis, potassium fluoride, which is the source of ions, lithium fluoride which prevents polarization, and ammonium fluoride which reduces the eutectic point. This example indicates that a quartenary system is a preferred alternative to a binary or ternary system used in the prior art.

The range of concentration of each component in the quaternary system used in an electrolyte in accordance with this procedure was determined by information obtained from other prior art binary or ternary systems as for example indicated in "Industrial and Engineering Chemistry", Volume 32, No. 4, 1942; The Chemistry of Fluorine and Inorganic compounds, Chapter 6 and the French Patent No. 2,082,366.

The following table provides an exemplary illustration of the quaternary system preferably utilized in the present system which consist of hydrogen fluoride, potassium fluoride, lithium fluoride and ammonium fluoride, in which the hydrogen fluoride is represented by X in mole fraction of the composition and potassium fluoride, lithium fluoride and ammonium fluoride are represented by Z mole fraction on the system. Potassium fluoride is 73% of Z, lithium fluoride is 5% of Z and ammonium fluoride is 22% of Z.

TABLE 1

| Temperature (°F.) | X | Z |
|---|---|---|
| 125 | 0.65 | 0.35 |
| 110 | 0.70 | 0.30 |
| 95 | 0.75 | 0.25 |

The preferable range for X is equal to or greater than 0.65 and equal or smaller than 0.75. The Z value corresponds to the balance or the remainder.

THE ELECTROLYTE—This system concerns the use of fluoride electrolytes in a wide range of temperatures varying from 30° F. to 300° F. When using the electrolyte in the electrolyzer, it must be at least 40° F. above the minimum point of the system. The electrolyte solution may consist of binary, ternary or quaternary systems. The following examples illustrate specific systems which can be used; however there is no specific restriction which limits it to these systems. Any of these systems can be referred to as a Hydrogen-Flouride electrolyte within the context of this specification.

Binary Electrolyte System—
The electrolyte solution consists of:
(Hydrogen*Fluoride) (Potassium*Fluoride)
HF—KF
70% mol HF, 30% mol KF
Ternary Electrolyte Systems—
The electrolyte solution consists of:
(Hydrogen*Fluoride) (Potassium*Fluoride)
(Lithium*Fluoride)
HF—KF—LiF
70% mol HF, 28.6% mol KF, 1.4% mol LiF
The electrolyte solution consists of:
(Hydrogen*Fluoride) (Potassium*Fluoride)

-continued (Aluminum*Fluoride)
HF—KF—AlF3
70% mol HF, 28.6% mol KF, 1.4% mol AlF3
The electrolyte solution consists of:
(Hydrogen*Fluoride) (Potassium*Fluoride)
(Sodium*Fluoride)
HF—KF—NaF
70% mol HF, 28.6% mol KF, 1.4% mol NaF
Quaternary Electrolyte Systems—
The electrolyte solution consists of:
(Hydrogen*Fluoride) (Potassium*Fluoride)
(Lithium*Fluoride) (Sodium *Fluoride)
HF—KF—LiF—NaF
70% mol HF, 27.2% mol KF, 1.4% mol LiF, 1.4% mol NaF
The electrolyte solution consists of:
(Hydrogen*Fluoride) (Potassium*Fluoride)
(Lithium*Fluoride) (Aluminum*Fluoride)
HF—KF—LiF—AlF3
70% mol HF, 27.2% mol KF, 1.4% mol LiF, 1.4% mol AlF3
The electrolyte solution consists of:
(Hydrogen*Fluoride) (Potassium*Fluoride)
(Aluminum*Fluoride) (Sodium*Fluoride)
HF—KF—AlF3—NaF
70% mol HF, 28.8% mol KF, 0.6% mol AlF3, 0.6% mol NaF
The electrolyte solution consists of:
(Hydrogen*Fluoride) (Potassium*Fluoride)
(Lithium*Fluoride) (Ammonium*Fluoride)
HF—KF—LiF—NH4F
70% mol HF, 22% mol KF, 1.4% mol LiF, 6.6% mol NH4F
The electrolyte solution consists of
(Hydrogen*Fluoride) (Potassium*Fluoride)
(Sodium*Fluoride) (Ammonium*Fluoride)
HF—KF—NaF—NH4F
70% mol HF, 22% mol KF, 1.4% mol NaF, 6.6% mol NH4F
The electrolyte solution consists of:
(Hydrogen*Fluoride) (Potassium*Fluoride)
(Aluminum*Fluoride) (Ammonium*Fluoride)
HF—KF—AlF3—NH4F
70% mol HF, 22% mol KF, 1.4% mol AlF3, 6.6% mol NH4F Each of the above examples are based upon a utilization of 70% by mole of hydrogen fluoride and 30% by mole of the salts in the solution. The preferable range of hydrogen fluoride is between 65 and 75% mole. For the examples which utilize binary and ternary solution, the eutectic point is approximately 150° F. The first three examples of the quaternary solution also has a eutectic point at approximately 150° while the last three quaternary systems has an estimated temperature of a minimum eutectic point of approximately 80° F.

The operation of the system provides, with proper voltages applied to the cathodes and anodes, that the electrolyte is pumped upwardly through the cells. As the electrolyte flows through the cells, fluorine is generated along the anode and hydrogen is generated along the cathode. As noted previously, the optimum shapes of the electrodes allow for a steady flow of the generated gases where no pockets form along the electrodes thus avoiding any increase in resistance and erosion.

The fluorine flows to the separator 982 and out of the separator to a collection means. In a similar manner, hydrogen flows to the separator 942 and subsequently, to a collection means.

Figure 10A:
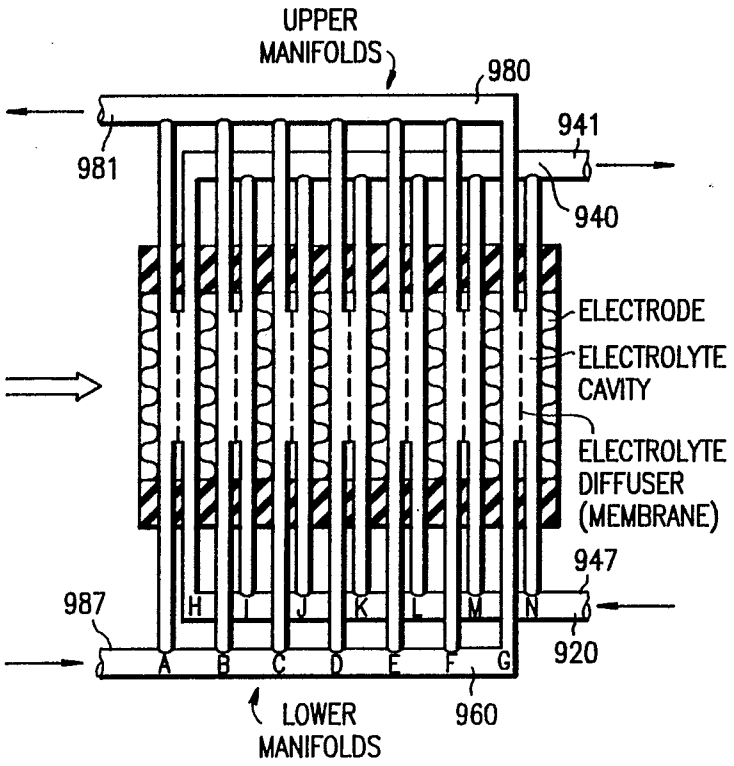

The requirement of the present invention utilizes equidistant planar, or flat electrodes with a geometry which prevents the accumulation of gas at any point on the surface. This increases both the efficiency of the electrolyzer as well as the life expectancy of the electrodes. The FIGS. 10 and 11 illustrate the electrolyte process as it relates to the present invention with the FIGS. 10A and 10B, respectively, illustrating the electrolyte flow of the countercurrent and parallel bipolar electrolyzers. If in one side of an electrolyzer, the left side or the right side, the two manifold connections are both inlets or both outlets, then the flow arrangement is PARALLEL FLOW and it corresponds to the INVENTION, but if the two manifold connections in one side of an electrolyzer, the left side or the right side, are one inlet and the other outlet, the flow arrangement is COUNTERCURRENT flow which corresponds to the prior art. In FIG. 10A, one side of the electrolyzer shows inlet 947 and outlet 941. The electrolyzer of FIG. 10A shows COUNTERCURRENT flow. In order for the electrolyte to flow in the manifolds there must exist a pressure differential on the electrolyte in the system. According to FIG. 10A, the pressure at A is higher than the pressure at B with the least pressure at G. In a similar manner, the pressure N is higher than the pressure at M with the least amount of pressure in the manifold being at H. The pressure differential in the outlet manifolds 940 and 980 have their least pressure at these specific outlets. Thus, with A being the highest pressure point in the inlet manifold and the least pressure point in the outlet manifold, the differential in A between the inlet and outlet manifolds is greater than at B with the least pressure differential in G.

Figure 12A:
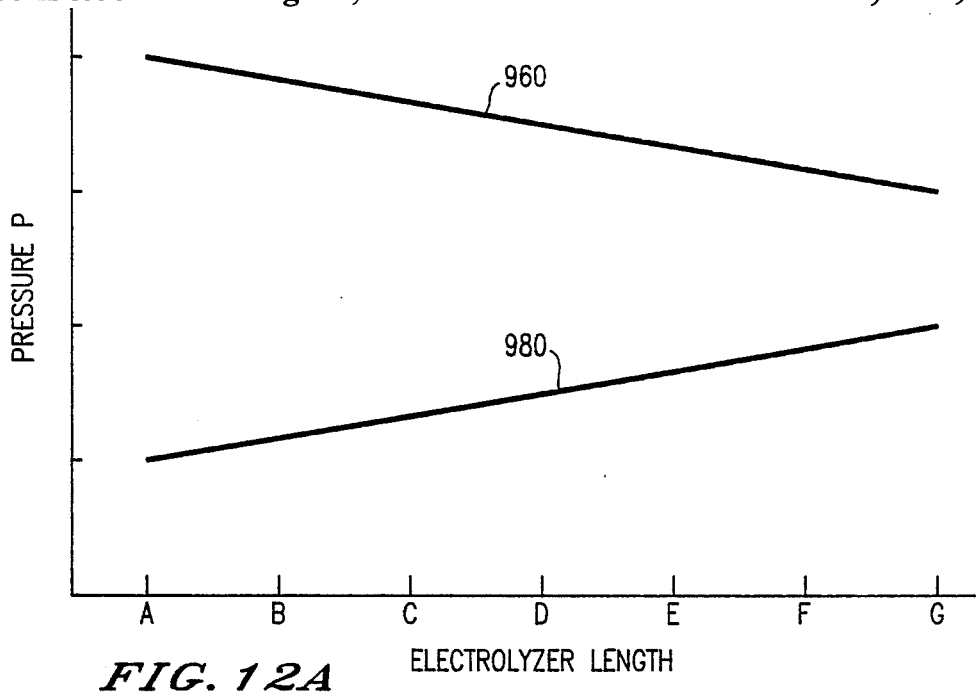
FIGS. 12A and 12B respectively show an electrolyte hydrodynamic for either monopolar or bipolar electrolyzers with respect to countercurrent flow and parallel flow illustrating an upper manifold and a lower manifold for each electrolyzer.
Figure 13A:
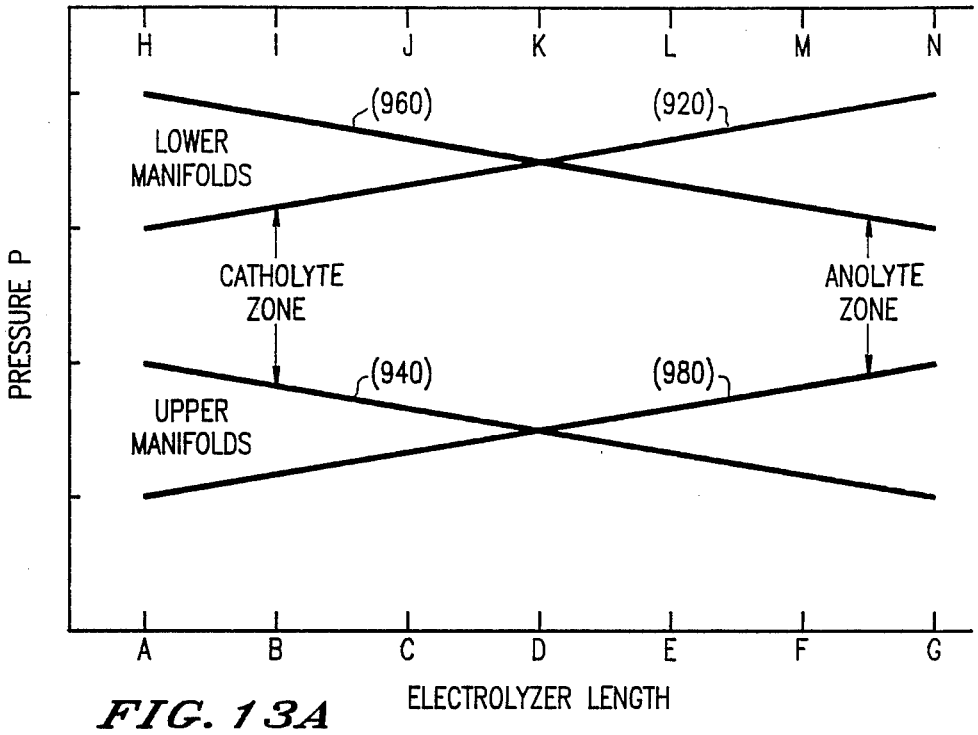
FIGS. 13A and 13B illustrate an electrolyte hydrodynamic for bipolar electrolyzers for respectively countercurrent flow and parallel flow for each of the upper and lower manifolds.

In a similar manner for the manifolds 920 and 940, the pressure differential at N is greatest and at H is the minimum. FIGS. 12A and 13A illustrate the electrolyte hydrodynamic graphic pressure versus electrolyzer length for one and two manifolds, respectively. These diagrams illustrate the pressure gradient which exists in the countercurrent flow electrolyzers which has been described above.

Figure 12B:
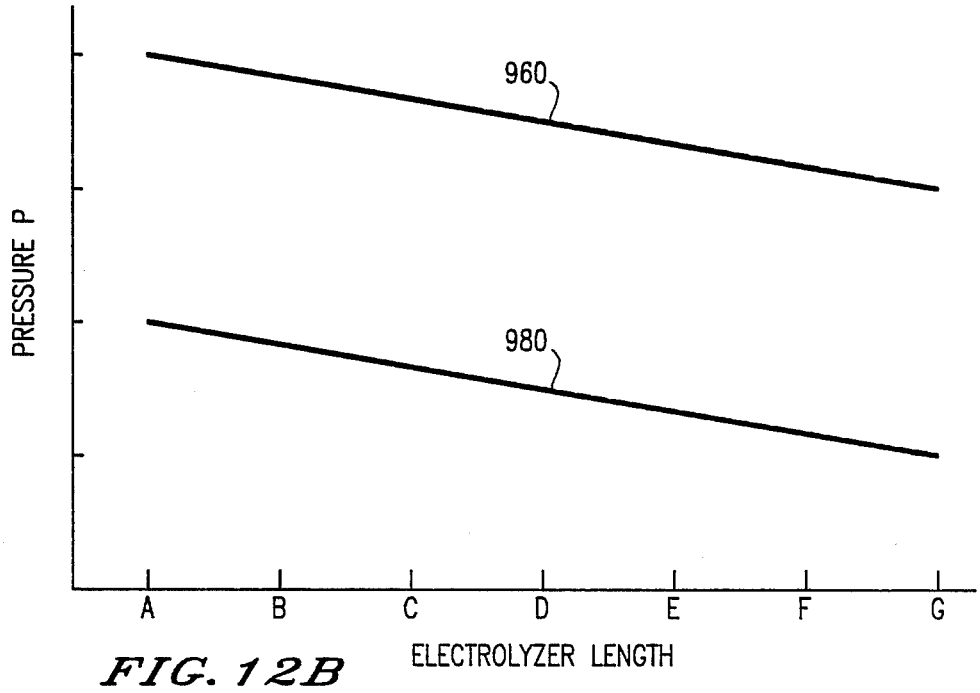
Figure 13B:
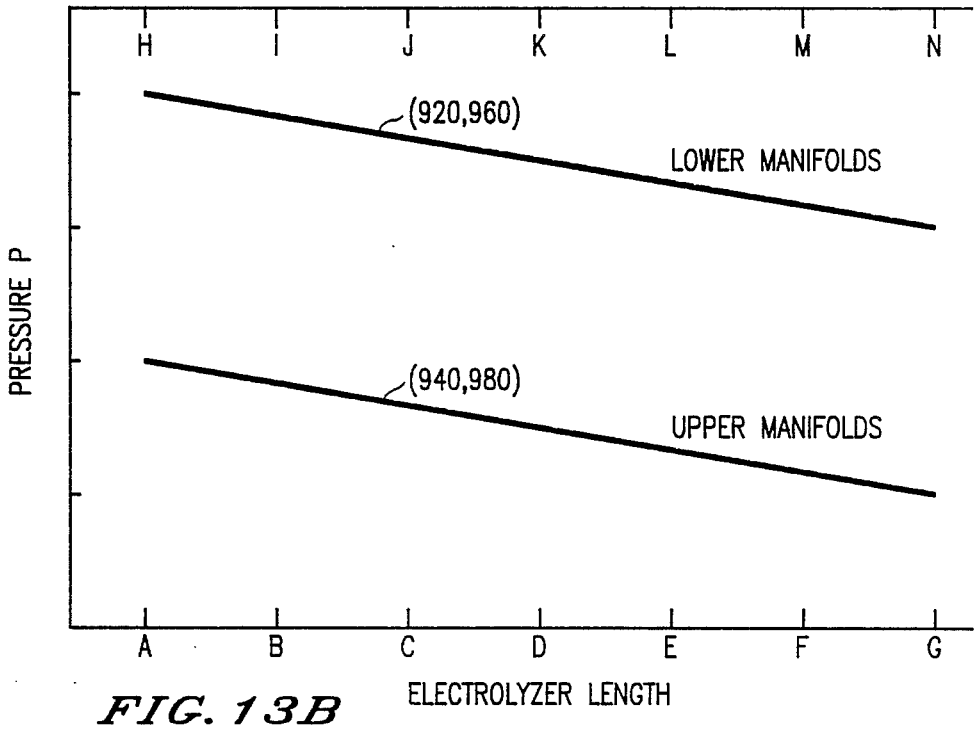

On the other hand, FIG. 10B illustrates an electrolyte parallel flow of a bipolar electrolyzer. In this bipolar parallel flow system, the inlet flow and the outlet flow are parallel to each other. The pressure gradient in the inlet flow of the system decreases as the distance from the inlet increases. Thus, A is the greatest pressure point, and in a similar manner, H is the greatest pressure point in the manifold 920. In the outlet manifolds 980 and 940, A and H are the greatest pressure points in their respective manifolds. As shown in FIGS. 12B and 13B, the pressure differential in A, B, . . . G are equal and have the minimum pressure at the outlets of the manifolds. Thus, the pressure at the points G and N (upper manifolds), are lower than the pressure at the pressure points A and H, (the lower manifolds).

Figure 11A:
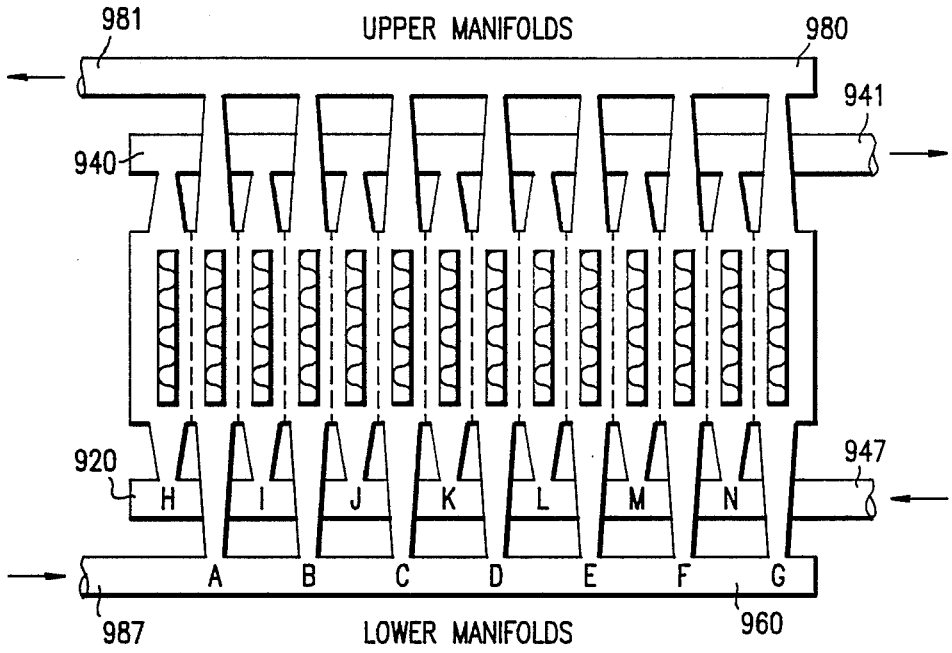
FIG. 11A and 11B respectively illustrate the electrolyte countercurrent and parallel flow of monopolar electrolyzers.
Figure 11B:
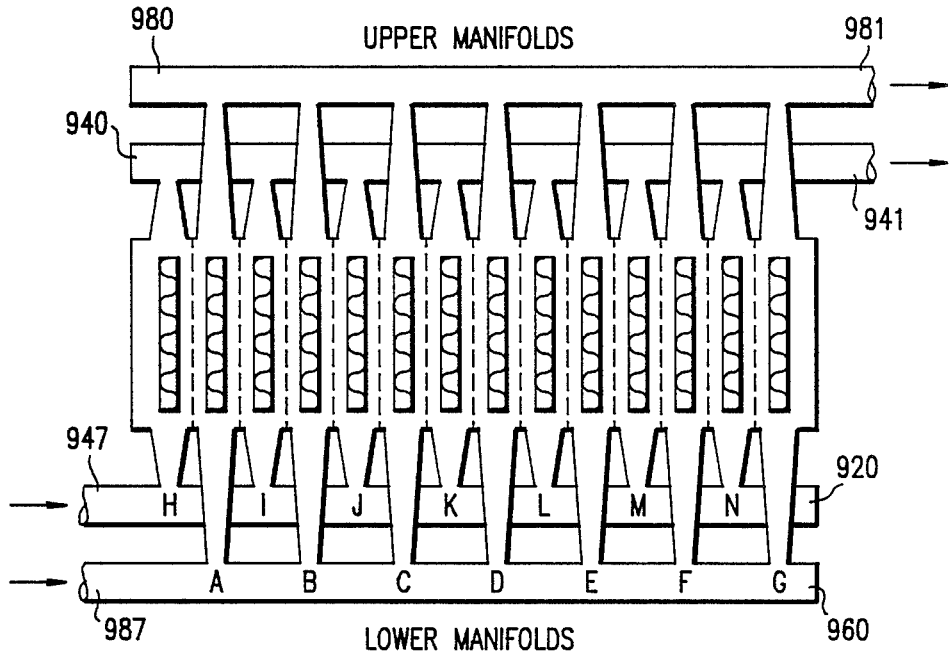

The electrolyte countercurrent and parallel flow for monopolar electrolyzers is shown in FIGS. 11A and 11B, respectively with FIG. 11A showing electrolyte countercurrent flow in which the inlet flow of the electrolyte at 947 and 987 is opposite to the outlet flow at 941 and 981, respectively. In order for electrolyte to flow in the manifolds, there must be a pressure differential on the electrolyte in the system. According to FIG. 11A, the pressure at A is higher than the pressure at B with the minimum pressure being G. In a similar manner, the pressure at N is higher than the pressure at M with the minimum pressure in the manifold being at H. The pressure differential in the outlet manifolds 940 and 980 have their minimum pressure at their outlets. Thus, with A being the highest pressure point in an inlet manifold, the pressure differential at point A between the inlet and outlet manifolds is greater than at B with the minimum pressure differential at G. Similarly, for the manifolds 920 and 940, the pressure differential is greatest at N while it is the least value (minimum value) at H.

Figure 14A:
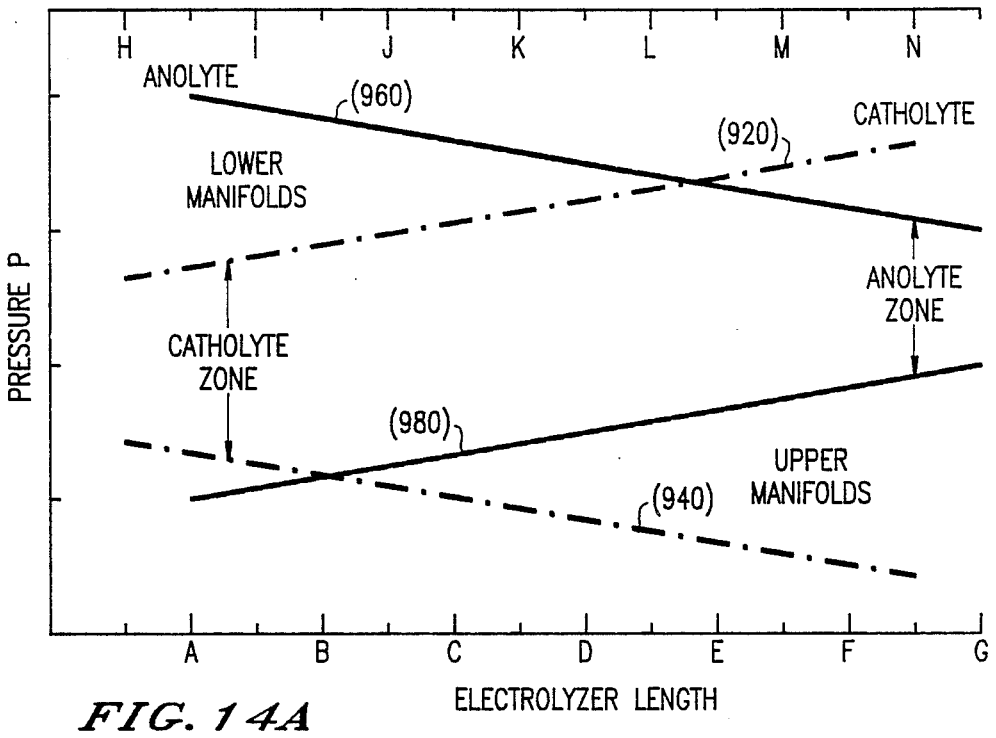
FIGS. 14A and 14B illustrate electrolyte hydrodynamic for monopolar electrolyzers during countercurrent flow and parallel flow respectively for both upper and lower manifolds.

The FIGS. 12A and 14A show the electrolyte hydrodynamics wherein the pressure is graphically illustrated as being dependent upon the electrolyzer length for one and two manifolds, respectively. These diagrams illustrate the pressure gradient which exists in the countercurrent flow type electrolyzers as previously described.

The electrolyte parallel flow of a monopolar electrolyzer is shown in FIG. 11B wherein the inlet flow and the outlet flow are parallel. The pressure gradient in the inlet manifolds of this system decrease as the distance from the inlet increases. Thus, the greatest pressure point is A and G is the minimum pressure point. In a similar manner, H is the greatest pressure point in the manifold 920 while in the outlet manifolds 980 and 940, A and H are the greatest pressure points for the respective manifolds.

Figure 14B:
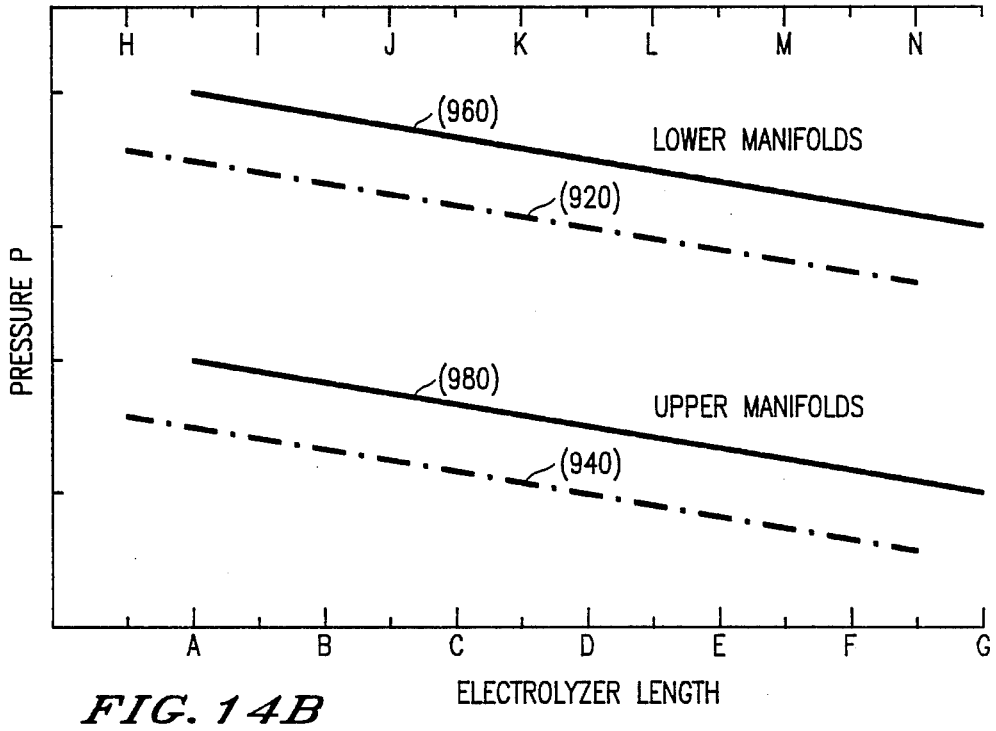

The pressure differential at A, B, . . . G, are equa: as shown in FIGS. 12B and 14B. The pressure differential at H, J, K . . . N are equal and also have the minimum pressure at the outlet of the manifolds. Thus the pressure points G and N (upper manifolds) have a lower pressure than the points A and H (lower manifolds).

Figure 8:
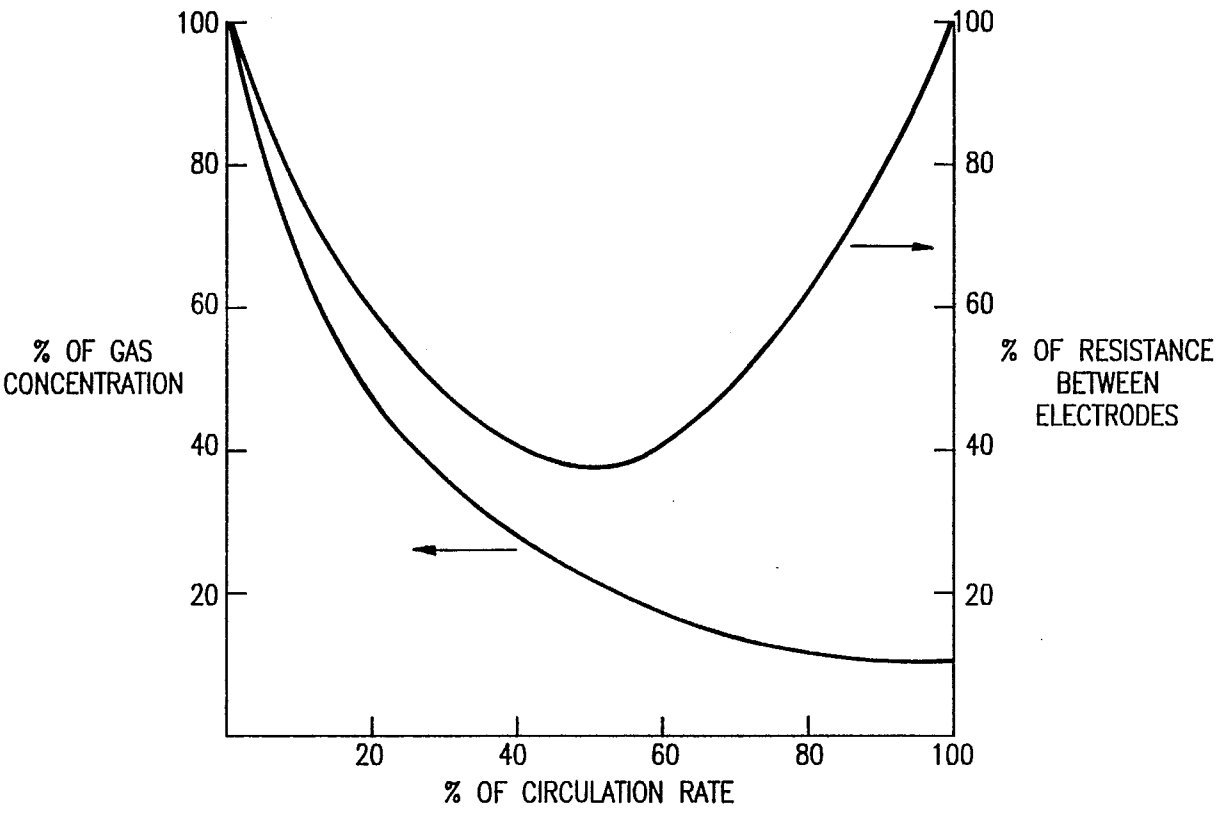
FIG. 8 graphically depicts the effects of the circulation of the electrolyte with respect to the gas concentration in the electrolyte and the resistance between the electrodes.

One of the prime operations of the electrolyzer which must be taken into account is the removal of the generated gas. In order to maintain the gas concentration in the electrolyte as low as possible, the electrolyte must be circulated in such a way as to assist in the removal of the gas phase. According to the present system, an electrolyte flow which is parallel to the planar electrodes and which is in an upward direction is the most practical and efficient method to achieve this gas removal. Additionally, the electrolyte velocity must be considered in the design as is shown in FIG. 8. The circulation rate of the electrolyte, in the cavity between the electrodes, has a range in which it must reside in order to achieve a minimization of the electrical resistance. This range is different from one system to another depending upon both the electrolyte and the electrolyzer. The use of electrolyte circulation according to the present invention further increases the efficiency of the electrolyzer and reduces the gas diffusion through the electrolyte diffuser. Furthermore, circulation of the electrolyte decreases the gas concentration and the heat generation of the electrode.

According to another concept of this embodiment, different circulation loops are used for the electrolyte in the cathodic zone and the anodic zone. This is an extremely important consideration because, in certain processes, the probability that gases from one zone can diffuse into the other zone leads not only to contamination of the gases but also to potentially dangerous conditions. By utilizing separate PARALLEL circulation loops for each zone this probability is minimized because each loop can operate at different pressures thereby preventing gas diffusion.

Because of the apparatus utilized in the present embodiment, the pressure, voltage and temperature can be controlled due to the provision of an external heat exchanger equipped to provide heating or cooling as it is required. When the demand for gas is low, the voltage automatically decreases, as does the evolution of heat. The external heat exchanger automatically adjusts the temperature.

According to the present system, high purity fluorine is produced in such a way that the gas is purified by the removal of Hydrogen Flouride at a low temperature. The recovered HF is sent to an electrolyzer; however, because of the low temperature, heat needs to be added to the electrolyte especially if the cell is in low demand or there is low voltage generation.

Using the present system, the module has a prolonged life independent of the electrolyte because of the geometry of the electrode structure and of the configuration of the cell unit module (as shown in FIGS. 6A and 6B). This arrangement promotes optimum velocity across the cell units parallel to each electrode thereby also preventing any gas accumulation inside the electrolyzer.

The compact monopolar electrolyzer structure is able to use both sides of each electrode to increase the efficiency of the electrolyzer, and because of the improved circulation rate within the module, the gas concentration in the electrolyte is low thereby preventing from one compartment to the other, i.e., from either the cathode to the anode or from anode to the cathode. There is no seal required between the two sides because each electrode has its own in the monopolar electrolyzer.

Because of the arrangement whereby each electrode generates on both sides only one gas, there is a better selection from the electrical point of view, and furthermore, the compatibility of fluorine and hydrogen, in the monopolar electrolyzer, provides for a system whereby the cathode is made of a copper material and the anode can be made of nickel. However, it must be emphasized that this is only one embodiment and other mater may be utilized.

The module is constructed simply, compactly and economically due to the availability of the materials.

The electrolyzer consists of one or more sections of monopolar units (each section having a voltage differential between the cathode and the anode in the range of from 3 to 18 volts and preferably 6 to 9 volts). Each section consists of at least two electrodes with one being cathode and one being an anode and the frame of the module can be made of plastic such as, fluorinated polyethylene, polytetrafluoroethylene, polyvinylidene fluoride, polyvinylfluoride, polypropylene, or an equivalent to any of these materials. The material for bracing and support which is used for framing the electrolyzer can be steel, aluminum, stainless steel, Monel etc.

Each cell unit has two zones with a temperature sensor to determine the gas diffusion from one zone to the other which is a safety feature which improves the efficiency and the safety of the process. The electrolytic process which occurs in this type of system can have a wide range of pressure which is a function of its mechanical design and characteristics of the module in a recommended range of up to 10 atmospheres in atmospheric pressure units.

A typical electrode size extends up to 100 square feet, but the preferred size is approximately 10 square feet with the number of cell units being available up to 1,000 having a preferred limit of 100. The distance between the electrode and the cathode ranges between $\frac{1}{2}$ to 4 inches with a preferable range of between $\frac{3}{4}$ and $1\frac{1}{4}$ inches while the distance between the electrode and the electrolyte diffuser is from $\frac{1}{8}$ to 2 inches with a preferable range of $\frac{3}{8}$ to $\frac{5}{8}$ inch.

The present system provides only two external electrical connections for an electrolyzer which is an improvement over the prior art monopolar electrolyzers which have electrodes individually connected externally to the busbar. This prior art arrangement provided for a potential for leakage through the connection points which is of course minimized by using only two external connection points. One of the external connection points is for the cathode and one is for the anode while FIG. 1A shows an external electrical connections for a monopolar electrolyzer and FIG. 1B shows the external electrical connections for a bipolar electrolyzer. The FIG. 9A shows the internal electrical setup for a monopolar electrolyzer, in which each electrode (either anode or cathode) has an individual internal connection point to the internal busbar. Lastly, FIG. 9B shows the internal electrical setup for a bipolar electrolyzer, in which each electrode has only one face as either the cathode or the anode.

Obviously, numerous additional modifications and variations of the present invention are possible in light of the above teachings. It is, therefore, to be understood that within the scope of the appended claims, the invention may be practiced otherwise than as specifically described herein.

What is claimed as new and desired to be secured by letters patent of the United States is:

1. An electrolytic apparatus for manufacturing fluorine comprising:

a first source of a first hydrogen fluoride electrolyte;

a second source of a second hydrogen fluoride electrolyte;

at least one electrolyzer cell unit wherein each of said at least one cell unit includes a cathode assembly having a planar cathode, an anode assembly having a planar anode and a membrane assembly situated between said cathode assembly and said anode assembly; and an electrolyte communication means for causing said first electrolyte to flow past both sides of each said planar cathode and for causing said second electrolyte to flow past both sides of each said planar anode, wherein both said anode assembly and said cathode assembly contain an opening for receiving and discharging said first and second electrolyte flowing past both sides of said anode and both sides of said cathode, respectively and wherein said opening has a shape which is the same as the shape of said anode and said cathode and wherein said shape allows for passage of said respective electrolyte without any accumulation of said electrolyte in the perimeter of said opening.

2. An apparatus according to claim 1, wherein each of said cathode, said anode and said openings are in the shape of an ellipse.

3. The apparatus according to claim 1, wherein each of said cathode, said anode and said openings are in the shape of a parallelagram.

4. An apparatus according to claim 1, wherein said electrolyte communication means includes a pair of input manifolds for receiving said first electrolyte and said second electrolyte, respectively, and feeding the respective electrolytes to said at least one cell unit and a pair of output manifolds for receiving said first and second electrolytes from said input manifolds, respectively, after passing through said at least one cell unit.

5. An apparatus according to claim 4, wherein said pair of output manifolds are fed into first and second separators, respectively wherein said first separator removes fluorine and wherein said second separator removes hydrogen.

6. The apparatus according to claim 5, wherein said first separator includes a means for combining electrolyte from said first source with the electrolyte remaining after removing fluorine and wherein said second separator includes a means for combining electrolyte from said second source with electrolyte remaining after removal of said hydrogen.

7. The apparatus according to claim 6, further comprising first and second heat exchangers wherein the input to said heat exchangers is connected to the output of said separators, respectively and wherein the output of said heat exchangers is connected to the input of said pump means.

8. The apparatus according to claim 5, further comprising an external heat exchanger system to control the temperature of said system providing on demand feeding and cooling wherein said external feed exchange system prevents solidification or crystal formation at the surface of the electrodes and said membranes.

9. An apparatus according to claim 4, further including a pump means for pumping both said first and said second electrolyte to said pair of input manifold means.

10. An apparatus according to claim 4, wherein the flow of electrolyte in each of said input manifolds is in the same direction and wherein the flow of electrolyte in each of said output manifolds is in the same direction.

11. The apparatus according to claim 4, wherein the flow of electrolyte from the inlet to the outlet of each associated pair of inlet and outlet manifolds of said manifolds is in the same direction in order to maintain the same pressure differential and the volumetric flow in each cell unit.

12. An apparatus according to claim 1, wherein the output of said electrolyte communication means is fed to a separator means which separates out fluorine and hydrogen.

13. An apparatus according to claim 1, wherein said cathode assembly and said anode assembly each contain a first frame, a second frame and a third frame wherein said frames are adjacent to each other with said second frame being positioned between said first frame and said third frame and wherein said opening is in each of said first, second and third frames with one of said cathode and said anode being positioned in said second frame and wherein said first frame opening forms the passage for said electrolyte to flow pass one side of one of said cathode and in the anode and wherein the said third frame opening forms a passageway for flow of electrolyte pass the second side of one of said cathode and said anode.

14. The apparatus according to claim 13, wherein each of said frames is made of plastic.

15. The apparatus according to claim 1, wherein said at least one electrolyzer cell unit is contained in a housing to thereby form a compact filter press.

16. The apparatus according to claim 15, wherein said housing is made of an insulating material.

17. The apparatus according to claim 16, further comprising a pair of external busbars fitted to one end of said housing and connected to a pair of internal busbars which extend to and through each of said anodes and each of said cathodes, respectively to form a monopolar electrolyzer.

18. The apparatus according to claim 15, further comprising a first external busbar on one end of said housing and a second external busbar on the other end of said housing wherein said first busbar is connected inside said housing to a first end plate on one end of said at least one cell unit and wherein said second external busbar is connected on the inside of said housing at said other end to a second end plate located opposite said first end plate of each of said at least one end unit to form a bipolar electrolyzer.

19. The apparatus according to claim 1, wherein said first and second hydrogen flouride electrolyte is a quaternary system consisting of hydrogen fluoride, potassium fluoride, lithium fluoride and ammonium fluoride.

20. The apparatus according to claim 19, wherein the mole fraction of hydrogen fluoride is between 0.65 and wherein the mole fraction of the combination of potassium fluoride, lithium fluoride and ammonium fluoride is the remainder with potassium fluoride being 73% of the remainder, lithium fluoride being 5% of the remainder and ammonium fluoride being 22% of the remainder.

21. The apparatus according to claim 1, wherein said membrane assembly includes a perfluorinated membrane to prevent gas diffusion between said anode assembly and said cathode assembly.

22. A gas producing electrolyzer comprising:

at least two sources of hydrodynamic electrolyte for producing at least two hydrodynamic electrolytes;

at least one electrolyzer cell unit including first and second electrode assemblies separated from each other by a membrane assembly wherein each of said first and second electrode assemblies contains an electrolyte communication means which receives a corresponding one of said electrolytes and wherein each of said electrode assemblies comprises a planar electrode wherein each of said electrolyte communication means includes a means for providing that said corresponding electrolyte flows pass both sides of said planar electrode and wherein the shape of each of said planar electrodes in the shape of an opening in each of said electrode assemblies on both sides of each of said electrodes is the same and wherein said openings and said electrodes have a shape which allows the passage of said corresponding electrolyte without gas accumulations in the perimeter of said opening.

23. The electrolyzer according to claim 22, wherein said electrodes are monopolar electrodes and include an anode electrode and a cathode electrode wherein said anode electrode is connected to a first external busbar and said cathode electrode is connected to a second external busbar in order to provide a monopolar electrolyzer.

24. The electrolyzer according to claim 22, wherein said electrodes are bipolar electrodes and wherein said apparatus further includes a first end plate connected at one end of said at least one electrolyte cell unit and a second end plate connected at the other end of said at least one electrolyte cell unit and wherein a first busbar is connected to said end plate at one end and a second busbar is connected to said end plate connected at the other end in order to provide a bipolar electrolyzer.

25. The electrolyzer according to claim 22, wherein said electrolyte is a hydrogen fluoride quaternary system electrolyte.

26. The electrolyzer according to claim 25, wherein said electrolyte consists of hydrogen fluoride and in the range between 0.65% and 0.75 mole with the remainder being potassium fluoride, lithium fluoride and ammonium fluoride.

27. The electrolyzer according to claim 22, wherein said electrodes are metallic in order to prevent by product formation by the reaction of the gas and the material of the electrode.

28. A method of manufacturing fluorine comprising the steps of:

providing a first source of a hydrodynamic hydrogen fluoride electrolyte;

providing a second source of a hydrodynamic hydrogen fluoride electrolyte;

flowing said hydrogen fluoride electrolyte of said first source past both sides of a first planar electrode;

flowing said electrolyte from said second source past both sides of a second planar electrode;

spacing said second electrode from said first electrode by a perfluorinated membrane;

shaping each of said electrodes and shaping a fluid receiving area on each side of said electrodes as to prevent gas accumulation in said fluid receiving area and on said electrodes.

29. The method according to claim 28, wherein said step of forming a shaped area includes the step of forming said area as one of an ellipse or a parallelogram with the major axis being in the direction of flow.

30. The method according to claim 29, further including the step of providing a separation of fluorine from said electrolyte of said first source after said electrolyte of said first source has passed said first electrolyte and for providing a separation of hydrogen from said electrolyte of said second source after said electrolyte of said second source has flowed passed said second electrolyte.

31. The method according to claim 28, further including the step of providing a first electrical connection to each of said first electrodes and a second electrical connection to each of said second electrodes in order to form a monopolar structure.

* * * * *